US011585609B2

(12) United States Patent
Zhou et al.

(10) Patent No.: US 11,585,609 B2
(45) Date of Patent: Feb. 21, 2023

(54) BENT HEAT EXCHANGER

(71) Applicant: SANHUA (HANGZHOU) MICRO CHANNEL HEAT EXCHANGER CO., LTD., Hangzhou (CN)

(72) Inventors: Jing Zhou, Hangzhou (CN); Qiang Gao, Hangzhou (CN); Xiaoming Zhong, Hangzhou (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 146 days.

(21) Appl. No.: 16/999,241

(22) Filed: Aug. 21, 2020

(65) Prior Publication Data

US 2020/0378692 A1 Dec. 3, 2020

Related U.S. Application Data

(63) Continuation-in-part of application No. 15/308,421, filed as application No. PCT/CN2015/078406 on May 6, 2015, now abandoned.

(30) Foreign Application Priority Data

May 6, 2014 (CN) ..... 201410188198.0

(51) Int. Cl.
*F28F 1/04* (2006.01)
*F28F 9/02* (2006.01)
*F28F 1/12* (2006.01)

(52) U.S. Cl.
CPC ..... *F28F 1/04* (2013.01); *F28F 1/126* (2013.01); *F28F 9/02* (2013.01)

(58) Field of Classification Search
CPC ..... F28F 1/02; F28F 1/022; F28F 1/04; F28F 1/12; F28F 1/126; F28F 1/128; F28F 1/14;

(Continued)

(56) References Cited

U.S. PATENT DOCUMENTS 4,316,503 A * 2/1982 Kurachi ..... F28F 9/16 29/523
4,960,169 A * 10/1990 Granetzke ..... F28F 9/0212 165/173

(Continued)

FOREIGN PATENT DOCUMENTS

CN 1191297 8/1998
CN 102390012 3/2012

(Continued)

OTHER PUBLICATIONS

IMPI, Office Action for MX App. No. MX/a/2016/014494, dated Mar. 4, 2021. Mar. 4, 2021.

(Continued)

*Primary Examiner* — Len Tran
*Assistant Examiner* — Gustavo A Hincapie Serna
(74) *Attorney, Agent, or Firm* — Hodgson Russ LLP

(57) ABSTRACT

A bent heat exchanger is provided. The bent heat exchanger includes: a first header and a second header; a plurality of flat tubes, two ends of the flat tube being connected to the first header and the second header respectively; and fins, each disposed between adjacent flat tubes, extending in a corrugated shape along a length direction of the flat tube. The first header and the second header each have a slot running through a wall thereof and a protrusion arranged to an inner surface of the wall thereof. The protrusion includes an arc portion connected to the edge of the slot, and an extension portion protruding inwards from the arc portion. An arc radius of the arc portion is less than or equal to and greater than 0.6 times a thickness of a wall of the corresponding first header or second header.

18 Claims, 7 Drawing Sheets

(58) Field of Classification Search
CPC ..... F28F 1/24; F28F 2210/00; F28F 2210/10; F28F 2215/00; F28F 2215/04; F28F 2275/04; F28F 9/02; F28F 9/18; F28D 1/02; F28D 1/024; F28D 2001/0266; F28D 2001/0273; F28D 1/04; F28D 1/047; F28D 1/0473; F28D 1/053; F28D 1/05366
USPC ..... 165/152
See application file for complete search history.

(56) References Cited

U.S. PATENT DOCUMENTS 5,695,004 A * 12/1997 Beckwith ..... F25B 40/00 165/104.21
5,826,649 A * 10/1998 Chapp ..... F28F 27/02 165/110
6,651,333 B2 * 11/2003 Letrange ..... F28F 9/18 29/890.052
7,908,126 B2 * 3/2011 Bahel ..... G06F 30/20 703/7
8,333,088 B2 * 12/2012 Taras ..... F25B 39/00 62/515
8,479,528 B2 * 7/2013 Muir ..... H05K 7/20827 62/89
10,612,865 B2 * 4/2020 Shin ..... F28F 9/0224
2004/0069476 A1 * 4/2004 Kitazaki ..... F28F 9/18 165/173
2005/0133207 A1 * 6/2005 Scoville ..... F28D 1/0443 165/140
2007/0169922 A1 * 7/2007 Pautler ..... F28D 1/05366 165/173
2007/0227695 A1 * 10/2007 Beamer ..... F28D 1/05366 165/76
2008/0141525 A1 * 6/2008 Breiding ..... B23K 1/008 29/726.5
2008/0202733 A1 * 8/2008 Samuelson ..... F28D 1/05366 165/173
2009/0126919 A1 * 5/2009 Bensel ..... F28F 9/0212 165/173
2010/0181058 A1 * 7/2010 Huazhao ..... F28D 1/05383 165/173
2011/0036550 A1 * 2/2011 Jiang ..... F28F 1/128 165/173
2011/0061844 A1 * 3/2011 Jianlong ..... F28F 9/0273 165/173
2011/0094257 A1 * 4/2011 Rusignuolo ..... F28D 1/0443 62/515
2011/0185574 A1 * 8/2011 Samuelson ..... F28D 1/05383 29/890.03
2015/0285571 A1 * 10/2015 Rouhana ..... F28D 1/05366 165/173
2016/0216047 A1 * 7/2016 He ..... B21D 53/085
2017/0146299 A1 * 5/2017 Steinbach ..... F28D 1/0476

FOREIGN PATENT DOCUMENTS

CN 103411446 11/2013
CN 103925745 7/2014
EP 0855567 7/1998
EP 3141858 1/2021
JP 2000356294 12/2000
JP 2002243381 8/2002

OTHER PUBLICATIONS

INPI, Office Action for BR App. No. BR112016025706-5, dated Jan. 11, 2021. Jan. 11, 2021.
IMPI, Office Action for MX App. No. MX/a/2016/014494, dated Sep. 2, 2020.

* cited by examiner

BENT HEAT EXCHANGER

RELATED APPLICATIONS

This application is a continuation-in-part of U.S. application Ser. No. 15/308,421, filed Nov. 2, 2016, which is a U.S. National Stage Entry of PCT/CN2015/078406, filed May 6, 2015, which claims priority to Chinese Patent Application No. 201410188198.0, filed May 6, 2014. The entire disclosures of the aforementioned applications are incorporated herein by reference.

FIELD

The present disclosure relates to a field of heat exchangers, and more particularly to a bent heat exchanger.

BACKGROUND

A heat exchanger, for example a parallel-flow heat exchanger (such as a multi-channel heat exchanger), is broadly applied to a refrigeration system, and in some application situations, the heat exchanger needs to be bent, that is, a header of the heat exchanger needs to be bent. However, when the heat exchanger is bent along a length direction of the header, if bent improperly, a performance of the heat exchanger will be affected adversely, or application requirements cannot be met. Thus, there exists a demand for improving the bent heat exchanger.

SUMMARY

Embodiments of the present disclose provide a bent heat exchanger. The bent heat exchanger includes: a first header and a second header, each of the first header and the second header including a bent segment and a straight segment adjoining the bent segment, the bent segment of the first header being corresponding to the bent segment of the second header; a plurality of flat tubes, two ends of the flat tube being connected to the first header and the second header respectively, the plurality of flat tubes being spaced apart from one another along axial directions of the first header and the second header; and fins, each disposed between adjacent flat tubes, extending in a corrugated shape along a length direction of the flat tube, and including flat-straight segments and arc segments, each arc segment being connected between adjacent flat-straight segments.

The first header and the second header each have a slot running through a wall thereof, and the flat tubes pass through the slots to extend into the first header and the second header, respectively. The first header and the second header each are further provided with a protrusion arranged to an inner surface of the wall thereof, and the protrusion includes an arc portion connected to an edge of the slot and an extension portion protruding inwards from the arc portion. An arc radius of the arc portion is less than or equal to a thickness of a wall of the corresponding first header or second header, and greater than 0.6 times the thickness of the wall of the corresponding first header or second header.

DETAILED DESCRIPTION

Figure 1:
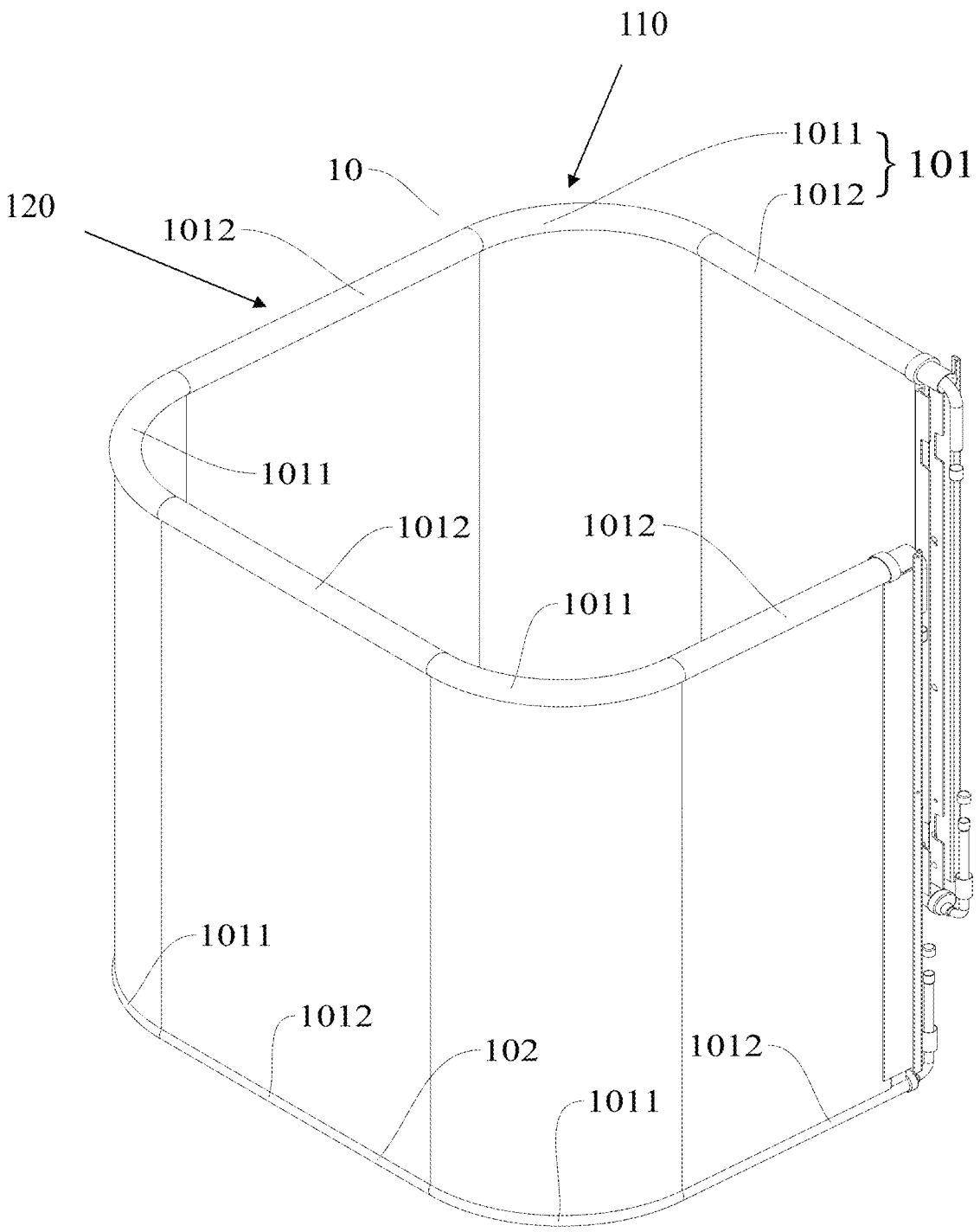
FIG. 1 is a perspective view of a bent heat exchanger according to embodiments of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure.

Based on following facts and problems discovered by inventors, the present disclosure is made.

When a heat exchanger is bent along a length direction of a header, if a bending radius is oversize, application requirements cannot be met in a case that a mounting space for the heat exchanger is limited. If the bending radius is undersize, a flat tube of the heat exchanger is deformed and a fin of the heat exchanger is torn, such that a heat exchange efficiency is affected, thus reducing a performance, even leading to a leakage of the flat tube and causing the heat exchanger to be scrapped. In addition, an excessive compression and deformation of the header may increase a pressure loss of coolant in the header and thus reduce the performance of the heat exchanger. Therefore, inventors realize that, a control of bending parameters is a factor affecting the performance, reliability and mounting-application convenience of the bent heat exchanger.

For that reason, an objective of the present disclosure is to provide a bent heat exchanger. Through a structural parameter design of the header, the flat tube and the fin, the bending radius of the header is controlled, such that when the heat exchanger is bent along the header, the fin at an outer side of the bending will not be torn, and the header after being bent has a reduced deformation and an enough bursting strength.

The bent heat exchanger according to some embodiments of the present disclosure includes: a first header and a second header, each of the first header and the second header including a bent segment and a straight segment adjoining the bent segment, the bent segment of the first header being corresponding to the bent segment of the second header; a plurality of flat tubes, two ends of the flat tube being connected to the first header and the second header respectively, the plurality of flat tubes being spaced apart from one another along axial directions of the first header and the second header; and fins, each disposed between adjacent flat tubes, extending in a corrugated shape along a length direction of the flat tube, and including flat-straight segments and arc segments, each arc segment being connected between adjacent flat-straight segments. A thickness of the fin is denoted as FT, the first header and the second header have different outer diameters, in which a larger one of the outer diameters of the first header and the second header is denoted as OD, the first header and the second header have different wall thicknesses, in which a larger one of the wall thicknesses of the first header and the second header is denoted as T, a width of the flat tube is denoted as W, an arc radius of the fin is denoted as FR, and a height of the fin is denoted as FH, in which $0.01 \leq (100 \times FT \times FR \times T)/(FH \times OD) \leq 9$.

The bent heat exchanger according to some other embodiments of the present disclosure includes: a first header and a second header, each of the first header and the second header including a bent segment and a straight segment adjoining the bent segment, the bent segment of the first header being corresponding to the bent segment of the second header; a plurality of flat tubes, two ends of the flat tube being connected to the first header and the second header respectively, the plurality of flat tubes being spaced apart from one another along axial directions of the first header and the second header; and a fin disposed between adjacent flat tubes, extending in a corrugated shape along a length direction of the flat tube, and including a plurality of flat-straight segments and an arc segment connected between the flat-straight segments. A thickness of the fin is denoted as FT, the first header and the second header have an equal outer diameter and both outer diameters of the first header and the second header are denoted as OD, the first header and the second header have an equal wall thickness and both wall thicknesses of the first header and the second header are denoted as T, a width of the flat tube is denoted as W, an arc radius of the fin is denoted as FR, and a height of the fin is denoted as FH, in which $0.01 \leq (100 \times FT \times FR \times T)/(FH \times OD) \leq 9$.

The thickness FT of the fin, the arc radius FR of a top of the fin and the height FH of the fin may cause an apparent tensile stress for the stretch of the fin during bending. The tensile stress is denoted as Sfin. When the tensile stress Sfin is larger than a yield strength $\sigma s$ of a welded joint of the fin and the flat tube, the fin tends to be separated from the flat tube, and even to be fractured. On the other hand, the wall thickness T and the outer diameter OD of the header may cause an apparent bending stress during bending. The bending stress is denoted as Shd. When the bending stress Shd is larger than a tensile strength $\sigma b$ of the header, the header will have a failure, and will have the failure under a certain pressure.

By tests under conditions of different bending radiuses, it is found that, under the application conditions of different bending radiuses R, a certain change relationship exists between a relative stress $Sfin/\sigma s$ on the fin, as well as a relative tensile stress $Shd/\sigma b$ on the header, and a recombination parameter $(100 \times FT \times FR \times T)/(FH \times OD)$ of the fin and the header. The relative stress $Sfin/\sigma s$ on the fin decreases along with the increasing of the recombination parameter, and rises rapidly when the recombination parameter decreases and approaches to zero. Further, the relative stress $Sfin/\sigma s$ on the fin generally decreases along with the rising of the bending radius R. The relative tensile stress $Shd/\sigma b$ on the header, along with the increasing of the recombination parameter, firstly decreases (the strength of the header is not enough when the wall thickness of the header is relatively small), and then rises gradually (a bending deformation stress rises when the relative wall thickness of the header is relatively large).

During an actual bending procedure, a bending radius of a traditional copper-tube and fin heat exchanger of an air conditioner generally is more than 50 mm. According to a condition that the relative stress $Sfin/\sigma s$ and the relative tensile stress $Shd/\sigma b$ should be lower than 1, so as to ensure that the bending intensity will not cause a failure, a lower limit and an upper limit of the recombination parameter $(100 \times FT \times FR \times T)/(FH \times OD)$ are respectively determined as 0.01 and 9. Through the determination of such scope, when the header is bent, an apparent tension fracture of the fin and a deformation failure or a bursting failure of the header will not come about in a micro-channel heat exchanger.

When a relation $0.01 \leq (100 \times FT \times FR \times T)/(FH \times OD) \leq 9$ is met, after the bent heat exchanger is bent along the length directions of the first header and the second header, it not only may be ensured that the fin is not torn and the flat tube is not deformed, but also may be ensured that the coil has an enough bursting strength. In addition, a change of a heat exchange performance of the bent heat exchanger may be limited within 4% (compared to the bent heat exchanger before being bent), an apparent unbalanced charging will not come about, and a drainage performance of the bent heat exchanger for the condensed water is optimal as well.

Therefore, the bent heat exchanger according to embodiments of the present disclosure has advantages of a reasonable structure, a steady construction, a high heat exchange efficiency, a great heat exchange performance, a high reliability, an easy mounting and application, and a great drainage performance.

In addition, the bent heat exchanger according to the above embodiments of the present disclosure may further include following additional technical features.

According to an embodiment of the present disclosure, $0.0004 \leq (FT \times FR)/(FH \times OD) \leq 0.59$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.02 \leq (FT \times FR)/FH \leq 6$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.002 \leq FT/FH \leq 0.04$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.0061 \leq FR/FH \leq 0.6$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.04 \leq T/OD \leq 0.25$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.0005 \leq FT/OD \leq 0.015$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.0016 \leq FR/OD \leq 0.4$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, $0.05 \leq FH/OD \leq 2$. Thus, it is further ensured that the fin is not torn, the flat tube is not deformed and the coil has the enough bursting strength. Also, the heat exchange efficiency and the drainage performance of the bent heat exchanger are further improved.

According to an embodiment of the present disclosure, the bent heat exchanger is configured to be C-shaped or L-shaped.

A bent heat exchanger 10 according to embodiments of the present disclosure will be described with reference to FIGS. 1-5 in the following. As shown in FIGS. 1-5, the bent heat exchanger 10 according to embodiments of the present disclosure includes a first header 101, a second header 102, fins 104 and a plurality of flat tubes 103.

Figure 2:
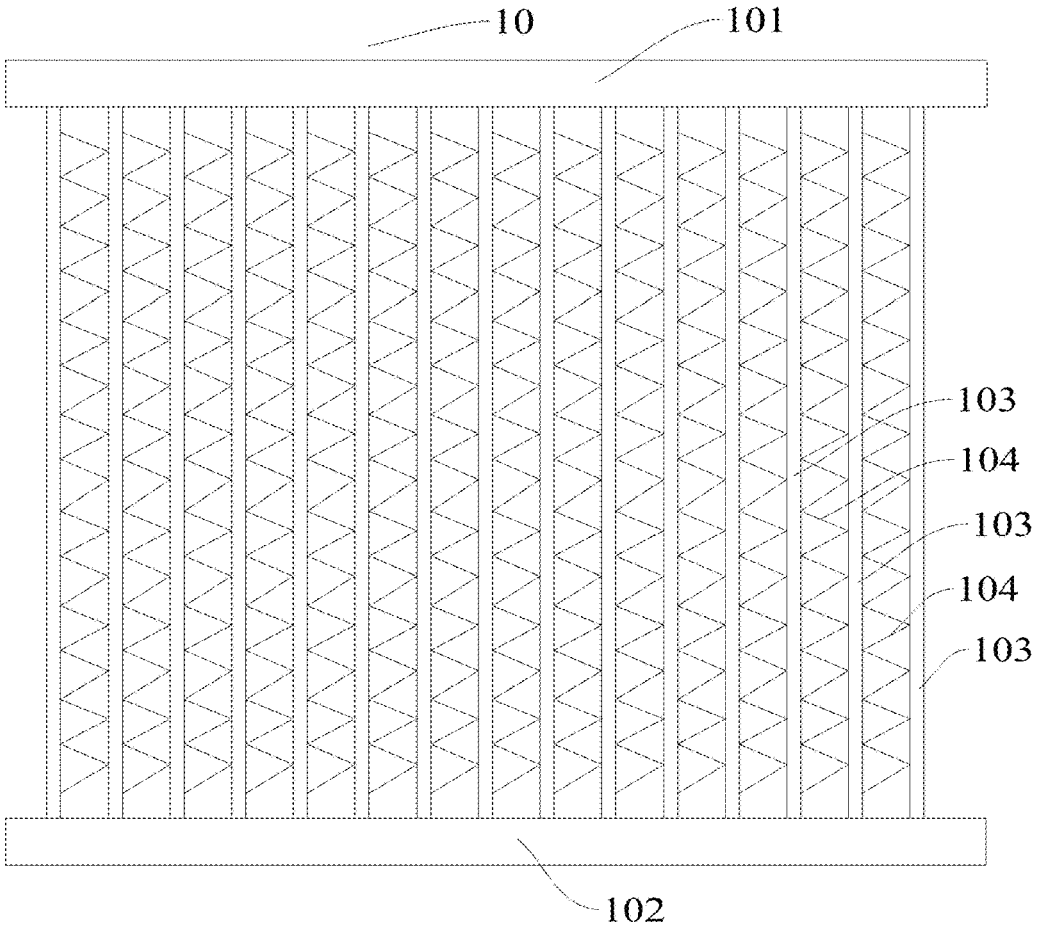
FIG. 2 is a schematic view of a bent heat exchanger before being bent according to embodiments of the present disclosure.
Figure 3:
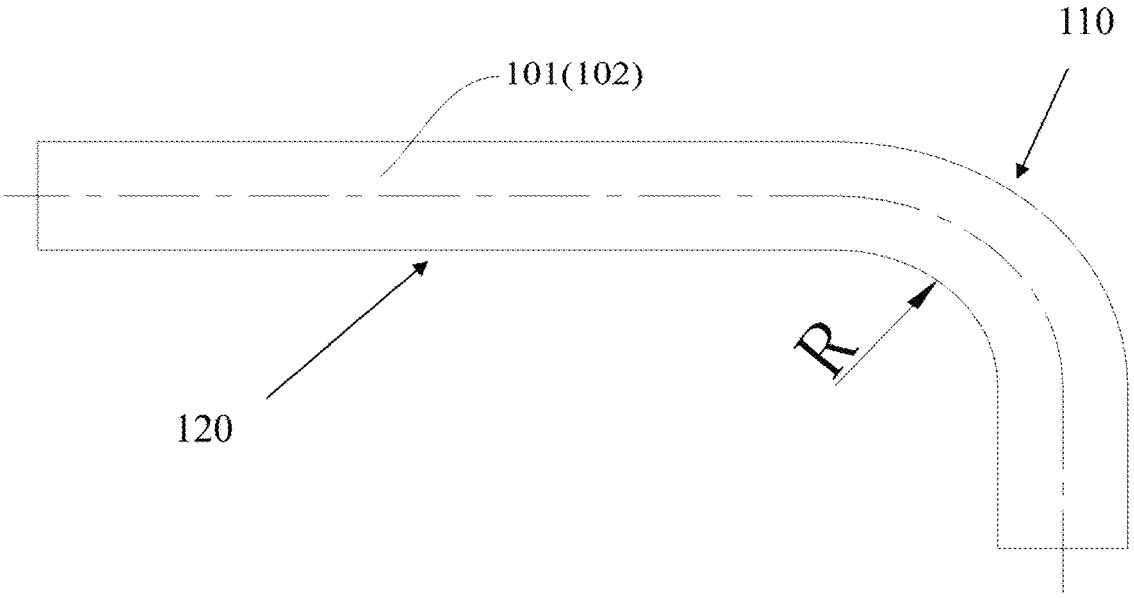
FIG. 3 is a schematic view of a header after being bent of a bent heat exchanger according to embodiments of the present disclosure.
Figure 4:
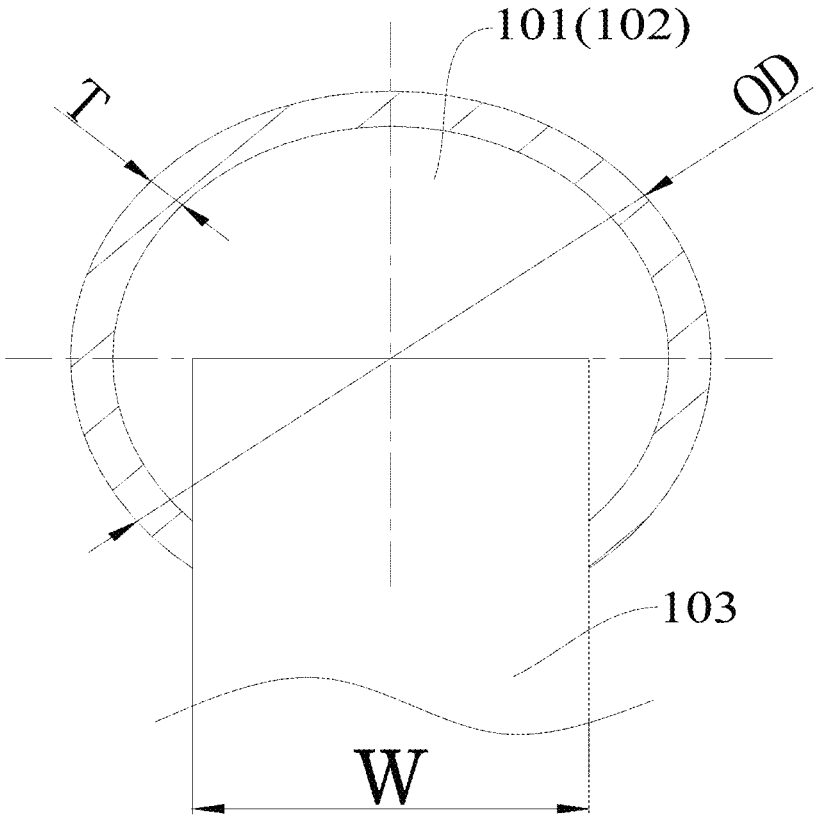
FIG. 4 is a schematic view of a header and a flat tube of a bent heat exchanger according to embodiments of the present disclosure.
Figure 5:
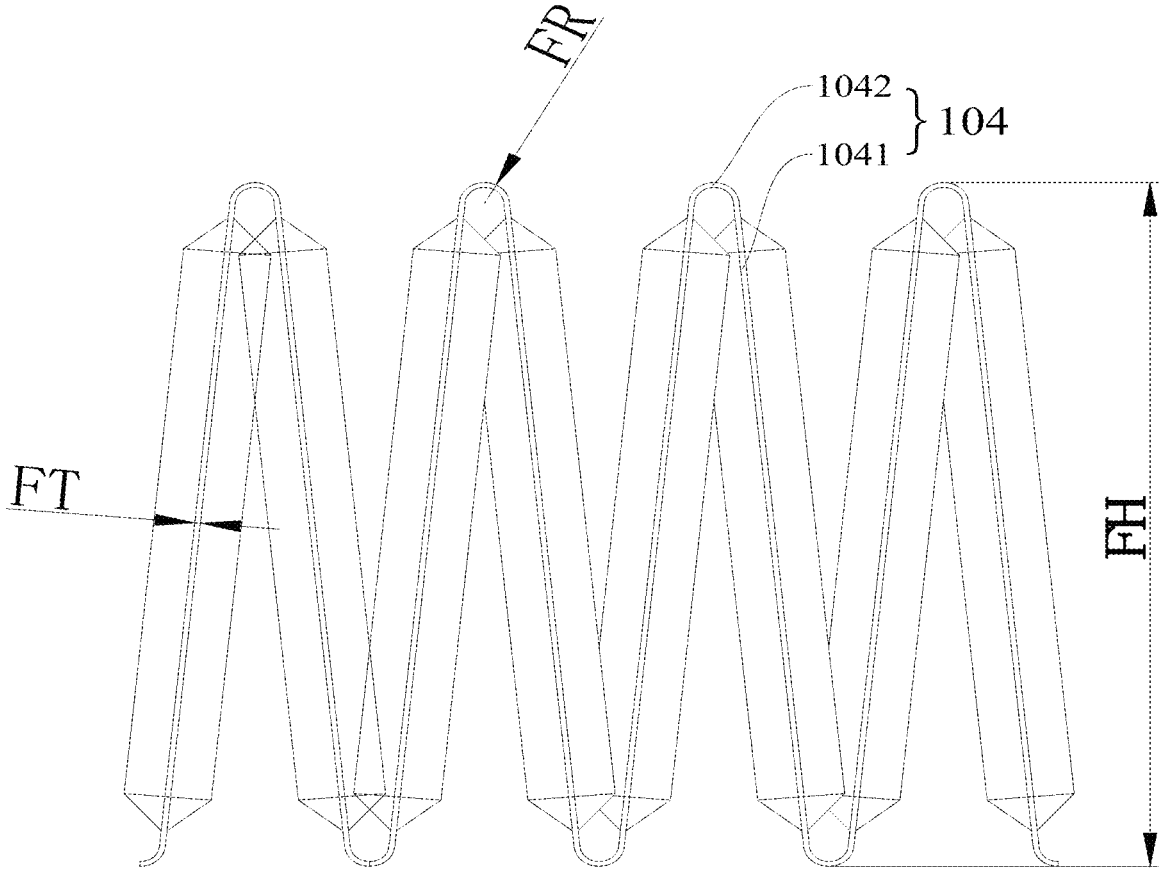
FIG. 5 is a schematic view of a fin of a bent heat exchanger according to embodiments of the present disclosure.

Each of the first header 101 and the second header 102 includes a bent segment 1011 and a straight segment 1012 adjoining the bent segment 1011. The bent segment 1011 of the first header 101 is corresponding to the bent segment 1011 of the second header 102. Two ends of the flat tube 103 are connected to the first header 101 and the second header 102 respectively, the plurality of flat tubes 103 are spaced apart from one another along axial directions of the first header 101 and the second header 102. Specifically, the first header 101 is parallel with the second header 102, i.e., the first header 101 has the same axial direction as the second header 102, as shown in FIGS. 1 and 2. Each fin 104 is disposed between adjacent flat tubes 103, and extends in a corrugated shape along a length direction of the flat tube 103. Specifically, the plurality of flat tubes 103 is parallel with one another, i.e., each flat tube 103 has a same length direction, as shown in FIG. 2. Each fin 104 includes flat-straight segments 1041 and arc segments 1042, and each arc segment 1042 is connected between adjacent flat-straight segments 1041.

A thickness of the fin 104 is denoted as FT, the first header 101 and the second header 102 may have different outer diameters, and a larger one of the outer diameters of the first header 101 and the second header 102 is denoted as OD. Optionally, the first header 101 and the second header 102 may have an equal outer diameter, and both the outer diameters of the first header 101 and the second header 102 are denoted as OD.

The first header 101 and the second header 102 may have different wall thicknesses, and a larger one of the wall thicknesses of the first header 101 and the second header 102 is denoted as T. Optionally, the first header 101 and the second header 102 may have an equal wall thickness, and both the wall thicknesses of the first header 101 and the second header 102 are denoted as T. A width of the flat tube 103 is denoted as W, an arc radius of the fin 104 is denoted as FR, and a height of the fin 104 is denoted as FH, in which $0.01 \leq (100 \times FT \times FR \times T)/(FH \times OD) \leq 9$.

It can be understood that, as mentioned above, the first header 101 and the second header 102 may have an equal outer diameter OD, and may as well have different outer diameters. When the first header 101 and the second header 102 have different outer diameters, the larger one of the outer diameters of the first header 101 and the second header 102 is denoted as OD. The first header 101 and the second header 102 may have an equal wall thickness T, and may as well have different wall thicknesses. When the first header 101 and the second header 102 have different wall thicknesses, the larger one of the wall thicknesses of the first header 101 and the second header 102 is denoted as T. Inventors of the present disclosure discover that, when the first header 101 and the second header 102 have different outer diameters and different wall thicknesses, the header having the larger outer diameter and/or the larger wall thickness is relatively difficult to be bent, and tends to be significantly influenced by bending. Certainly, in embodiments of the present disclosure, the first header 101 and the second header 102 may have an equal outer diameter and an equal wall thickness. When the first header 101 and the second header 102 have the equal outer diameter and/or the equal wall thickness, the outer diameter OD may be the outer diameter of any one of the first header 101 and the second header 102, and the wall thickness T may be the wall thickness of any one of the first header 101 and the second header 102.

Through deep research and creative work, inventors discover following things.

When a thickness (the width W of the flat tube 103) of a coil is determined, a decrease of a bending radius R will cause an overall bursting strength of the coil to be lowered, and therefore the wall thicknesses of the first header 101 and the second header 102 need to be increased (the outer diameters of the first header 101 and the second header 102 are not changed), or the outer diameters of the first header 101 and the second header 102 need to be decreased (the wall thicknesses of the first header 101 and the second header 102 are not changed), so as to meet strength requirements. However, increasing the wall thicknesses of the first header 101 and the second header 102, not only increases a cost, but also decreases internal volumes of the first header 101 and the second header 102. In addition, in a heat pump system having the bent heat exchanger 10 at an outdoor unit, there exists an apparent difference between an internal volume of an indoor unit and an internal volume of the outdoor unit, and the decreases of the internal volumes of the first header 101 and the second header 102 will make the unit have an unbalanced charging at a refrigerating condition and a heating condition.

On the other hand, in terms of design of the fin 104, after the first header 101 and the second header 102 are bent, an arc portion at a top of the fin 104 will be stretched after being bent, and therefore the larger the arc radius of the top of the fin 104 is, the more stretch thereof may be generated, thus bearing a larger bending stress and preventing a tear from being formed at a welding seam due to an excessive stretch of the fin 104. But, an oversize arc radius may cause condensed water to accumulate at the arc portion due to a surface tension effect thereof, and thus it is not easy for the condensed water to be discharged out of the fin 104. Moreover, increasing the arc radius of the top of the fin 104 may increase a risk of the fin 104 collapsing after being welded.

The strength of the fin 104 is in direct proportion to the thickness of the fin 104, a thicker fin 104 may resist a larger bending stress, and therefore it is not easy for the flat tube 103 after being bent to have a wavy deformation. But, increasing the thickness of the fin 104 not only results in an increased cost of the bent heat exchanger 10, but also causes an increased ventilation resistance, thus reducing a performance of the unit.

The height of the fin 104 will as well influence the bending performance, the larger the height of the fin 104 is, the larger a spacing between the flat tubes 103 is, and thus a support force to the first header 101 and the second header 102 within per unit length is smaller, such that it is easier for the first header 101 and the second header 102 is to be deformed after being bent. However, the smaller the height of the fin 104 is, the larger the ventilation resistance is.

The thickness FT of the fin 104, the arc radius FR of the top of the fin 104 and the height FH of the fin 104 may cause an apparent tensile stress for the stretch of the fin 104 during the bending. The tensile stress is denoted as Sfin. When the tensile stress Sfin is larger than a yield strength as of a welded joint of the fin 104 and the flat tube 103, the fin 104 tends to be separated from the flat tube 103, and even to be fractured. On the other hand, the wall thicknesses T and the outer diameters OD of the first header 101 and the second header 102 may cause an apparent bending stress during the bending, and the bending stress is denoted as Shd. When the bending stress Shd is larger than a tensile strength σb of the first header 101 and the second header 102, the first header 101 and the second header 102 may have a failure, and may have the failure under a certain pressure.

Figure 6:
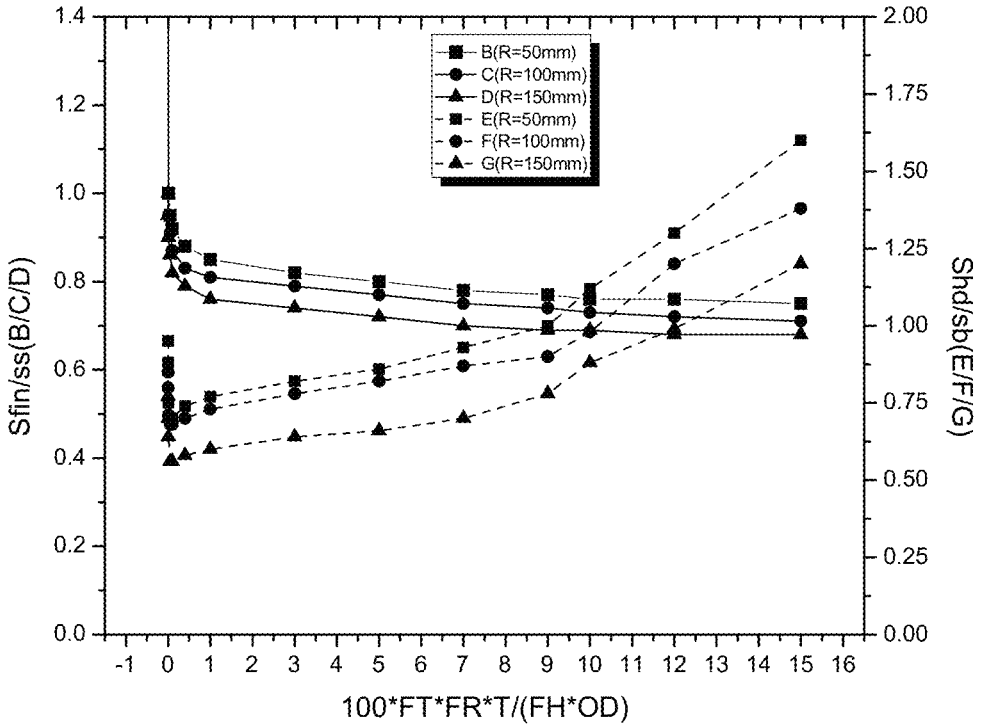
FIG. 6 is a graph showing a relation curve between a relative stress on a fin, as well as relative tensile stresses on a first header and a second header, and a recombination parameter, under conditions of different bending radiuses.

By tests under conditions of different bending radiuses R, it is found that under the application conditions of different bending radiuses R, a certain change relationship exists between a relative stress Sfin/σs on the fin 104, as well as relative tensile stresses Shd/σb on the first header 101 and the second header 102, and a recombination parameter (100×FT×FR×T)/(FH×OD) of the fin 104, the first header 101 and the second header 102. As shown in FIG. 6, the relative stress Sfin/σs on the fin 104 decreases along with the increasing of the recombination parameter, and rises rapidly when the recombination parameter decreases and approaches to zero. Further, the relative stress Sfin/σs on the fin 104 decreases generally along with the rising of the bending radius R. The relative tensile stresses Shd/σb on the first header 101 and the second header 102, along with the increasing of the recombination parameter, firstly decrease (the strength of the header is not enough when the wall thicknesses of the first header 101 and the second header 102 are relatively small), and then rise gradually (a bending deformation stress rises when the relative wall thickness of the first header 101 and the second header 102 is relatively large).

During an actual bending procedure, a bending radius of a traditional copper-tube and fin heat exchanger of an air conditioner is generally more than 50 mm. According to a condition that the relative stress Sfin/σs and the relative tensile stress Shd/σb should be lower than 1, so as to ensure that the bending intensity will not cause a failure, a lower limit and an upper limit of the recombination parameter (100×FT×FR×T)/(FH×OD) are determined respectively as 0.01 and 9. Through the determination of such scope, when the first header 101 and the second header 102 are bent, an apparent tension fracture of the fin and a deformation failure or a bursting failure of the header will not come about in the bent heat exchanger 10.

By consideration of various factors, when the relation 0.01≤(100×FT×FR×T)/(FH×OD)≤9 is met, after the bent heat exchanger 10 is bent along length directions of the first header 101 and the second header 102, it not only may be ensured that the fin 104 is not tom and the flat tube 103 is not deformed, but also may be ensured that the coil has an enough bursting strength. In addition, a change of a heat exchange performance of the bent heat exchanger 10 may be limited within 4% (compared to the bent heat exchanger 10 before being bent), the apparent unbalanced charging will not come about, and a drainage performance of the bent heat exchanger 10 for the condensed water is optimal as well.

Therefore, the bent heat exchanger 10 according to embodiments of the present disclosure has advantages of a reasonable structure, a steady construction, a high heat exchange efficiency, a great heat exchange performance, a high reliability, an easy mounting and application, and a great drainage performance.

More specifically, the axial directions of the first header 101 and the second header 102 may be the length directions of the first header 101 and the second header 102.

When a length unit for each of the thickness FT of the fin 104, the larger outer diameter OD of the outer diameters of the first header 101 and the second header 102, the larger wall thickness T of the wall thicknesses of the first header 101 and the second header 102, the width W of the flat tube 103, the arc radius FR of the fin 104 and the height FH of the fin 104 is millimeter, 0.01 mm≤(100×FT×FR×T)/(FH×OD)≤9 mm, the same as below.

As shown in FIG. 1, in some embodiments of the present disclosure, the bent heat exchanger 10 may be configured to be C-shaped. In other words, the bent heat exchanger 10 may be bent three times along the length directions of the first header 101 and the second header 102. That is, each of the first header 101 and the second header 102 may include three bent segments 1011 and four straight segments 1012, and each bent segment 1011 is located between two adjacent straight segments 1012.

In addition, the bent heat exchanger 10 may also be configured to be L-shaped.

Preferably, 0.1≤(100×FT×FR×T)/(FH×OD)≤7. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Further preferably, 0.5≤(100×FT×FR×T)/(FH×OD)≤5. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Most preferably, 1≤(100×FT×FR×T)/(FH×OD)≤3. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Advantageously, the thickness FT of the fin 104, the arc radius FR of the fin 104, the height FH of the fin 104, and the larger outer diameter OD of the outer diameters of the first header 101 and the second header 102 meet a following relation: 0.0004≤(FT×FR)/(FH×OD)≤0.59. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Further advantageously, 0.004≤(FT×FR)/(FH×OD)≤0.3. Most advantageously, 0.04≤(FT×FR)/(FH×OD)≤0.1. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The thickness FT of the fin 104, the arc radius FR of the fin 104 and the height FH of the fin 104 may meet a following relation: 0.02≤(FT×FR)/FH≤6. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Preferably, 0.05≤(FT×FR)/FH≤3. Further preferably, 0.1≤(FT×FR)/FH≤2. Most preferably, 0.5≤(FT×FR)/FH≤1. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The thickness FT of the fin 104 and the height FH of the fin 104 may meet a following relation: 0.002≤FT/FH≤0.04. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Advantageously, 0.005≤FT/FH≤0.01. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The arc radius FR of the fin 104 and the height FH of the fin 104 may meet a following relation: 0.0061≤FR/FH≤0.6. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Preferably, 0.01≤FR/FH≤0.3. Further preferably, 0.05≤FR/FH≤0.1. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The larger wall thickness T of the wall thicknesses of the first header 101 and the second header 102 and the larger outer diameter OD of the outer diameters of the first header 101 and the second header 102 may meet a following relation: 0.04≤T/OD≤0.25. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Preferably, 0.1≤T/OD≤0.2. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The thickness FT of the fin 104 and the larger outer diameter OD of the outer diameters of the first header 101 and the second header 102 may meet a following relation: 0.0005≤FT/OD≤0.015. Thus, it is further ensured that the fin 104 is not torn, the flat tube 103 is not deformed and the coil has the enough bursting strength. Also, the heat exchange efficiency and the drainage performance of the bent heat exchanger 10 are further improved.

Preferably, 0.001≤FT/OD≤0.01. Further preferably, 0.003≤FT/OD≤0.007. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The arc radius FR of the fin 104 and the larger outer diameter OD of the outer diameters of the first header 101 and the second header 102 meet a following relation: 0.0016≤FR/OD≤0.4. Thus, it is further ensured that the fin 104 is not tom, the flat tube 103 is not deformed and the coil has the enough bursting strength. Also, the heat exchange efficiency and the drainage performance of the bent heat exchanger 10 are further improved.

Preferably, 0.016≤FR/OD≤0.1. Thus, it is further ensured that the fin 104 is not torn, the flat tube 103 is not deformed and the coil has the enough bursting strength. Also, the heat exchange efficiency and the drainage performance of the bent heat exchanger 10 are further improved.

The height FH of the fin 104 and the larger outer diameter OD of the outer diameters of the first header 101 and the second header 102 may meet a following relation: 0.05≤FH/OD≤2. Thus, it is further ensured that the fin 104 is not tom, the flat tube 103 is not deformed and the coil has the enough bursting strength. Also, the heat exchange efficiency and the drainage performance of the bent heat exchanger 10 are further improved.

Preferably, 0.1≤FH/OD≤1. Further preferably, 0.3≤FH/OD≤0.7. Thus, it is further ensured that the fin 104 is not torn, the flat tube 103 is not deformed and the coil has the enough bursting strength. Also, the heat exchange efficiency and the drainage performance of the bent heat exchanger 10 are further improved.

In the heat exchanger 10 according to the embodiments of the present disclosure, since each of the first header 101 and the second header 102 has the bent segment 1011 and the straight segment 1012 adjoining the bent segment 1011, the heat exchanger 10 has a bent region 110 and a straight region 120 adjacent to the bent region 110 accordingly. The bent region 110 corresponds to the bent segment 1011 and the straight region 120 corresponds to the straight segment 1012.

In the prior heat exchanger, the flat tubes with the small width or no flat tubes or few flat tubes are usually provided in the bent region 110, so as to ensure the reliability of bending, but this will decrease the heat exchange performance.

Figure 7:
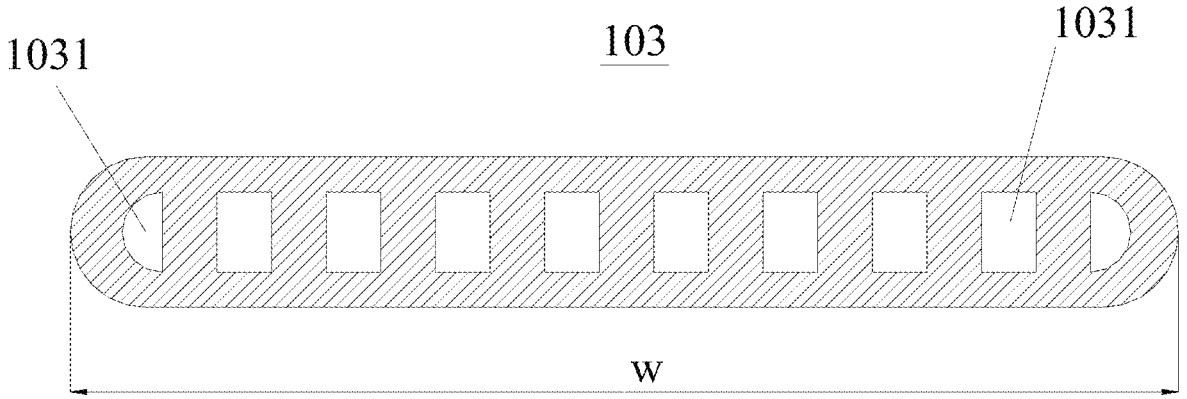
FIG. 7 is a sectional view of a flat tube of a bent heat exchanger according to an embodiment of the present disclosure.

In the heat exchanger 10 according to the embodiment of the present disclosure, the flat tube 103 in the bent region 110 has a same width as the flat tube 103 in the straight region 120, but a flow cross-sectional area of the flat tube 103 in the bent region 110 is less than a flow cross-sectional area of the flat tube 103 in the straight region 120. The flat tube 103 has a plurality of flow channels 1031, the plurality of flow channels 1031 are spaced apart from one another along a width direction of the flat tube 103, and each flow channel 1031 extends along the length direction of the flat tube 103, and has a flow cross-sectional area in a cross section of the flat tube 103, as shown in FIG. 7.

In other words, the flow cross-sectional area of the flat tube 103 is a sum of the flow cross-sectional areas of the plurality of flow channels 1031 in the flat tube 103, so the sum of the flow cross-sectional areas of the plurality of flow channels 1031 of the flat tube 103 in the bent region 110 is less than the sum of the flow cross-sectional areas of the plurality of flow channels 1031 of the flat tube 103 in the straight region 120.

It can be understood that "the flat tube 103 in the bent region 110" intends to mean each flat tube 103 in the bent region and "the flat tube 103 in the straight region 120" intends to mean each flat tube 103 in the straight region 120, herein.

In the heat exchanger 10 according to the embodiment of the present disclosure, the flat tube 103 in the bent region 110 and the flat tube 103 in the straight region 120 have the same width, such that the fin 104 in the bent region 110 and the fin 104 in the straight region 120 also have the same width accordingly, that is, a surface area of the fin 104 in the bent region 110 is identical or similar to a surface area of the fin 104 in the straight region 120. In this case, a heat exchange area on an air side of the bent region 110 is identical or similar to a heat exchange area on an air side of the straight region 120.

Similarly, "the fin 104 in the bent region 110" intends to mean each fin 104 in the bent region 110, and "the fin 104 in the straight region 120" intends to mean each fin 104 in the straight region 120.

In addition, since the flow cross-sectional area of the flat tube 103 in the bent region 110 is reduced, the flow resistance of the refrigerant increases, then the refrigerant flow through the bent region 110 decreases, and the degree of superheat increases in bent region 110, thereby reducing the difference of the refrigerant superheat degree between the flat tube 103 at the outlet in the bent region 110 and the flat tube 103 at the outlet in the straight region 120, and hence improving the overall heat exchange efficiency of the heat exchanger 10.

In some embodiments, along the length direction of the flat tube 103, the flow cross-sectional area of the flow channel 1031 of the flat tube 103 in the bent region 110 or the straight region 120 may change, and the maximum value of the flow cross-sectional area of the flow channel 1031 is used to calculate the said sum of the flow cross-sectional areas of the flow channels 1031, i.e. the flow cross-sectional area of the flat tube 103.

In some embodiments of the present disclosure, the flow cross-sectional area of at least one flow channel 1031 of at least one flat tube 103 in the bent region 110 or the straight region 120 may change along the length direction of the flat tube 103.

In some embodiments of the present disclosure, the flow cross-sectional area of the flat tube 103 may be reduced by reducing a thickness of the flat tube 103 or reducing a size of a hole forming the flow channel 1301 in the flat tube 103.

Figure 8:
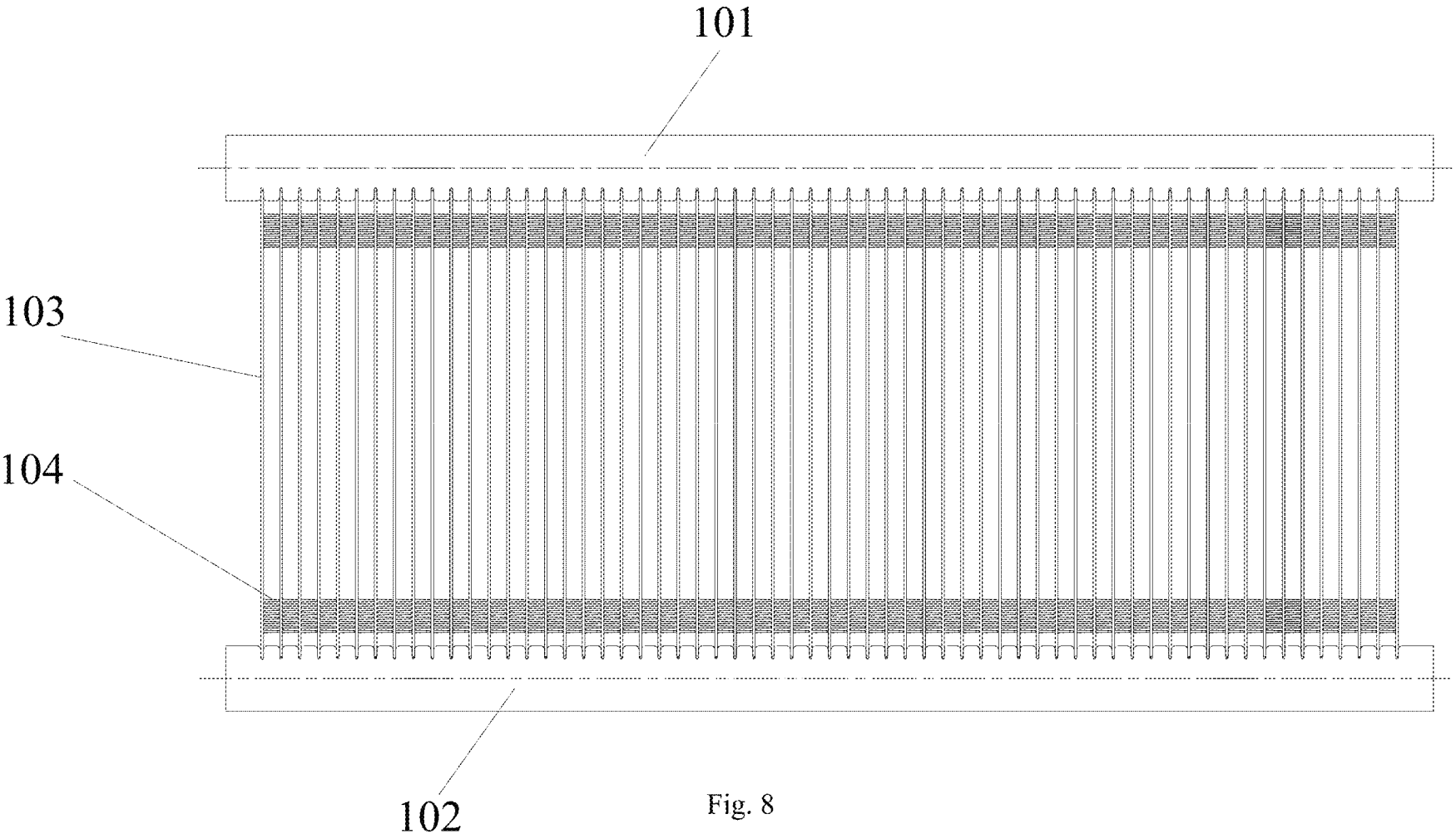
FIG. 8 is another schematic view of a bent heat exchanger before being bent according to an embodiment of the present disclosure.
Figure 9:
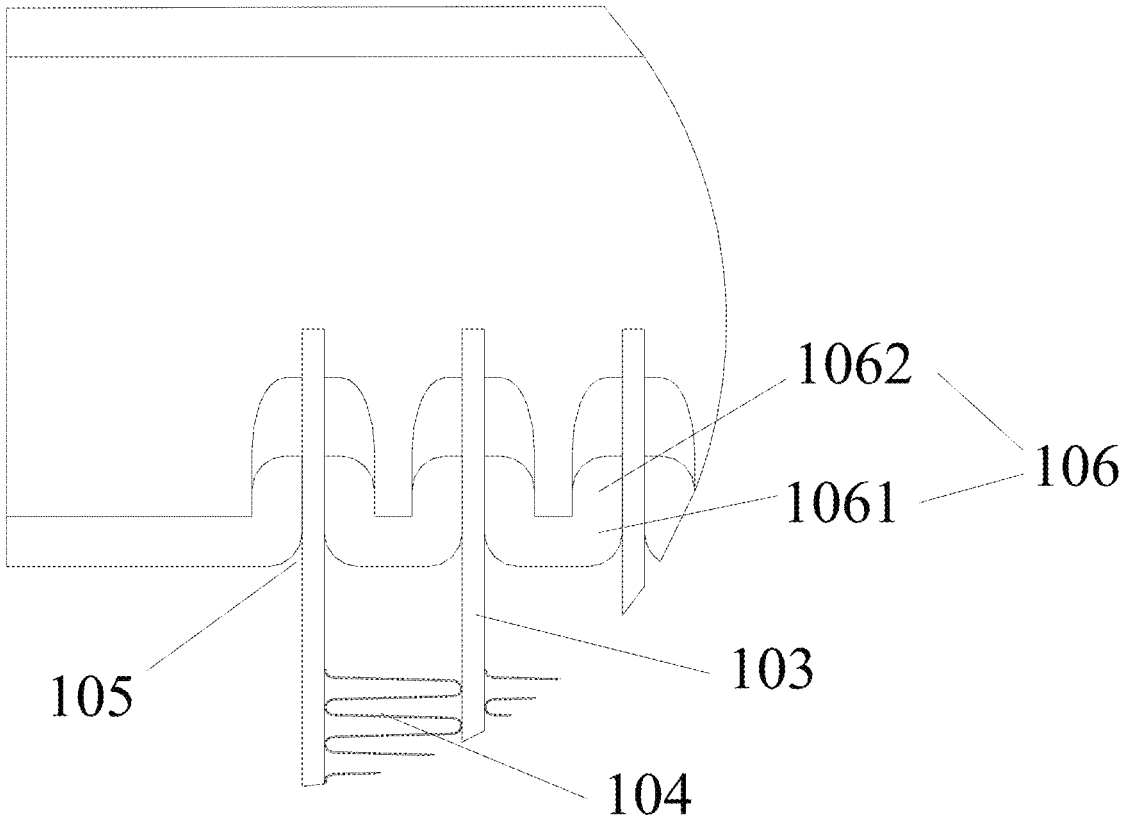
FIG. 9 is a partial schematic view of the bent heat exchanger in FIG. 8.

In the heat exchanger 10 according to the embodiment of the present disclosure, the first header 101 and the second header 102 each have a slot 105 running through a wall thereof, as shown in FIGS. 8-9. The flat tubes 103 pass through the slots 105 to extend into the first header 101 and the second header 102, respectively, so as to communicate the first header 101 with the second header 102. Furthermore, the wall of the first header 101 and the second header 102 are also provided with a protrusion 106 at an edge of the slot 105 to fix the flat tube 103. Specifically, the protrusion 106 is arranged to an inner surface of the wall of the first header 101 or the second header 102, surrounds at least a part of the edge of the slot 105, and protrudes from the edge of the slot 105 towards a central axis of the first header 101 or the second header 102.

In some embodiments of the present disclosure, the protrusion 106 may be configured as a turnup, but is not limited to this.

Further, the flat tube 103 passes through the slot 105 and a part of the surface of the flat tube 103 is connected to the protrusion 106 by welding. Specifically, the flat tube 103 and the protrusion 106 are connected by brazing.

When the first header 101 and the second header 102 are bent, the first header 101 and the second header 102 are deformed, that is, the bent segment 1011 is formed, such that the connection of the flat tube 103 and the first header 101 or the second header 102 is affected.

In some embodiments of the present disclosure, there is a gap between the protrusion 106 and the flat tube 103, and an adhesive, such as a brazing flux, is filled in the gap to connect the flat tube 103 and the protrusion 106, and hence with the header.

When there is too much brazing flux, the brazing flux will flow to an inner cavity of the header, which may cause the flat tube 103 to be blocked due to the welding. Furthermore, when the welding is completed, the brazing flux will produce some pores after being cooled. The larger the amount of the brazing flux, the more pores. These pores may become stress concentration points after the first header 101 and the second header 102 are bent, thus affecting the service life of the heat exchanger 10, and also increasing the risk of leakage during use.

When the gap between the protrusion 106 and the flat tube 103 is too small, the brazing flux is insufficiently filled, thus affecting the connection strength between the flat tube 103 and the first header 101 or the second header 102. Especially, when the first header 101 and the second header 102 are bent, the risk of the connection between the flat tube 103 and the first header 101 or the second header 102 being broken increases.

In some embodiments of the present disclosure, as shown in FIG. 9, the protrusion 106 includes an arc portion 1061 connected to the edge of the slot 105 and an extension portion 1062 protruding inwards from the arc portion 1061. An arc radius of the arc portion 1061 is less than or equal to a thickness of the wall of the corresponding first header 101 or second header 102, and greater than 0.6 times the thickness of the wall of the corresponding first header 101 or second header 102. That is, a ratio of the arc radius of the arc portion 1061 to the thickness of the wall of the corresponding first header 101 or second header 102 is less than or equal to 1 and greater than 0.6, thus reducing the risk of the connection between the flat tube 103 and the first header 101 or the second header 102 being broken during the bending, and hence reducing the impact on the service life of the heat exchanger 10.

Herein, "corresponding" may be understood as a meaning that the arc portion 1061 of the protrusion 106 in the first header 101 corresponds to the first header 101, and the arc portion 1061 of the protrusion 106 in the second header 102 corresponds to the second header 102.

In other words, the arc radius of the arc portion 1061 located in the first header 101 is less than or equal to the thickness of the wall of the first header 101, and greater than 0.6 times the thickness of the wall of the first header 101, and the arc radius of the arc portion 1061 located in the second header 102 is less than or equal to the thickness of the wall of the second header 102, and greater than 0.6 times the thickness of the wall of the second header 102.

Therefore, by controlling the structural design of the protrusion 106, the adaptability of the connection between the flat tube 103 and the first header 101 or the second header 102 to the bending of the header can be improved.

In some embodiments of the present disclosure, the slot 105 may be formed by stamping. In the process of stamping, the thickness of the wall of the first header 101 or the second header 102 may change, a certain part thereof may become thicker, and another part thereof may become thinner, so the arc radius of the arc portion 1061 should be less than or equal to the minimum thickness of the wall of the corresponding first header 101 or second header 102, and greater than 0.6 times the minimum thickness of the wall of the corresponding first header 101 or second header 102.

In other embodiments of the present disclosure, the thickness of the wall of the first header 101 or the second header 102 may also be an average thickness of the wall or a thickness of materials before being processed.

In the specification, it is to be understood that terms such as "central", "longitudinal", "lateral", "length", "width", "thickness", "upper", "lower", "front", "rear", "left", "right", "vertical", "horizontal", "top", "bottom", "inner", "outer", "clockwise" and "counterclockwise" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted", "connected", "coupled", "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on", "above" or "on top of" a second feature may include an embodiment in which the first feature is right or obliquely "on", "above" or "on top of" the second feature, or just means that the first feature is at a height higher than that of the second feature; while a first feature "below", "under" or "on bottom of" a second feature may include an embodiment in which the first feature is right or obliquely "below", "under" or "on bottom of" the second feature, or just means that the first feature is at a height lower than that of the second feature.

Reference throughout this specification to "an embodiment", "some embodiments", "one embodiment", "another example", "an example", "a specific example" or "some examples" means that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in another example", "in an example", "in a specific example" or "in some examples" in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A bent heat exchanger, comprising:

a first header and a second header, each of the first header and the second header comprising a bent segment and a straight segment adjoining the bent segment, the bent segment of the first header being corresponding to the bent segment of the second header;

a plurality of flat tubes, two ends of each flat tube being connected to the first header and the second header respectively, the plurality of flat tubes being spaced apart from one another along axial directions of the first header and the second header; and fins, each disposed between adjacent flat tubes, extending in a corrugated shape along a length direction of the flat tubes, and comprising flat-straight segments and arc segments, each arc segment being connected between adjacent flat-straight segments, wherein the first header and the second header each has a plurality of slots running through a wall thereof, and the flat tubes pass through the slots to extend into the first header and the second header, respectively, the first header and the second header each are further provided with a plurality of protrusions arranged to an inner surface of the wall thereof, each protrusion of the plurality of protrusions comprises an arc portion connected to an edge of a respective slot and an extension portion protruding inwards from the arc portion, and the extension portion extends towards an interior of the first header or the second header, an arc radius of the arc portion is less than or equal to a thickness of a wall of the corresponding first header or second header, and greater than 0.6 times the thickness of the wall of the corresponding first header or second header, wherein the bent heat exchanger has a bent region and a straight region adjacent to the bent region, and the bent segment is arranged in the bent region, and the straight segment is arranged in the straight region, wherein the flat tubes in the bent region have a same width as the flat tubes in the straight region, and a flow cross-sectional area of the flat tubes in the bent region is less than a flow cross-sectional area of the flat tubes in the straight region.

2. The bent heat exchanger according to claim 1, wherein the arc radius of the arc portion located in the first header is less than or equal to the thickness of the wall of the first header, and greater than 0.6 times the thickness of the wall of the first header, and the arc radius of the arc portion located in the second header is less than or equal to the thickness of the wall of the second header, and greater than 0.6 times the thickness of the wall of the second header.

3. The bent heat exchanger according to claim 1, wherein each flat tube of the plurality of flat tubes passes through a respective slot of the plurality of slots and is connected to a protrusion of the plurality of protrusions by welding.

4. The bent heat exchanger according to claim 3, wherein the flat tubes and the protrusions are connected by brazing.

5. The bent heat exchanger according to claim 1, wherein the slots are formed by stamping, different parts of the wall of the first header have different thicknesses, and different parts of the wall of the second header have different thicknesses.

6. The bent heat exchanger according to claim 5, wherein the arc radius of the arc portion located in the first header is less than or equal to a minimum thickness of the wall of the first header, and greater than 0.6 times the minimum thickness of the wall of the first header, and the arc radius of the arc portion located in the second header is less than or equal to a minimum thickness of the wall of the second header, and greater than 0.6 times the minimum thickness of the wall of the second header.

7. The bent heat exchanger according to claim 1, wherein the flat tubes have a plurality of flow channels, and the plurality of flow channels are spaced apart from one another along a width direction of the flat tubes, and each flow channel extends along the length direction of the flat tubes and has a flow cross-sectional area in a cross section of the flat tubes.

8. The bent heat exchanger according to claim 7, wherein a sum of the flow cross-sectional areas of the flow channels of the flat tubes in the bent region is less than a sum of the flow cross-sectional areas of the flow channels of the flat tubes in the straight region.

9. The bent heat exchanger according to claim 8, wherein the flow cross-sectional area of at least one of the flow channels of at least one of the flat tubes in the bent region or the straight region changes along the length direction of the flat tube, and a maximum value of the flow cross-sectional area of the at least one of the flow channels is used to obtain the sum of the flow cross-sectional areas of the flow channels of the flat tubes in the bent region or the straight region.

10. The bent heat exchanger according to claim 1, wherein a thickness of the fin is denoted as FT, the first header and the second header have an equal outer diameter and both outer diameters of the first header and the second header are denoted as OD, the first header and the second header have an equal wall thickness and both wall thicknesses of the first header and the second header are denoted as T, a width of the flat tube is denoted as W, an arc radius of the fin is denoted as FR, and a height of the fin is denoted as FH, wherein $0.01 \leq (100 \times FT \times FR \times T)/(FH \times OD) \leq 9$.

11. The bent heat exchanger according to claim 10, wherein, $0.0004 \leq (FT \times FR)/(FH \times OD) \leq 0.59$.

12. The bent heat exchanger according to claim 10, wherein, $0.02 \leq (FT \times FR)/FH \leq 6$.

13. The bent heat exchanger according to claim 10, wherein, $0.002 \leq FT/FH \leq 0.04$.

14. The bent heat exchanger according to claim 10, wherein, $0.0061 \leq FR/FH \leq 0.6$.

15. The bent heat exchanger according to claim 10, wherein, $0.04 \leq T/OD \leq 0.25$.

16. The bent heat exchanger according to claim 10, wherein, $0.0005 \leq FT/OD \leq 0.015$.

17. The bent heat exchanger according to claim 10, wherein, $0.0016 \leq FR/OD \leq 0.4$.

18. The bent heat exchanger according to claim 10, wherein, $0.05 \leq FH/OD \leq 2$.

* * * * *